US010265770B2

(12) United States Patent
Wilkinson

(10) Patent No.: US 10,265,770 B2
(45) Date of Patent: Apr. 23, 2019

(54) BINDERLESS METAL INJECTION MOLDING APPARATUS AND METHOD

(71) Applicant: The Boeing Company, Huntington Beach, CA (US)

(72) Inventor: Carey E Wilkinson, O'Fallon, MO (US)

(73) Assignee: The Boeing Company, Chicago, IL (US)

( * ) Notice: Subject to any disclaimer, the term of this patent is extended or adjusted under 35 U.S.C. 154(b) by 605 days.

(21) Appl. No.: 14/489,328

(22) Filed: Sep. 17, 2014

(65) Prior Publication Data

US 2015/0004047 A1 Jan. 1, 2015

Related U.S. Application Data

(60) Continuation of application No. 13/486,126, filed on Jun. 1, 2012, now abandoned, which is a division of application No. 12/034,196, filed on Feb. 20, 2008, now abandoned.

(51) Int. Cl.

| | |
|---|---|
| ***B22F 3/093*** | (2006.01) |
| ***B22F 3/00*** | (2006.01) |
| ***B22F 3/22*** | (2006.01) |

(52) U.S. Cl.

CPC ..... *B22F 3/093* (2013.01); *B22F 3/003* (2013.01); *B22F 3/225* (2013.01); *B22F 2999/00* (2013.01)

(58) Field of Classification Search

CPC ..... B22F 3/003; B22F 3/093; B22F 3/225; B22F 2999/00; B22F 2202/01

See application file for complete search history.

(56) References Cited

U.S. PATENT DOCUMENTS

| | | | | |
|---|---|---|---|---|
| 3,165,570 | A | 1/1965 | Deutsch | |
| 3,181,211 | A | 5/1965 | Rearwin | |
| 5,360,329 | A | 11/1994 | Lemelson | |
| 5,641,920 | A | 6/1997 | Hens et al. | |
| 5,993,507 | A | 11/1999 | Baum et al. | |
| 6,187,259 | B1 | 2/2001 | Yamashita et al. | |
| 6,296,044 | B1 | 10/2001 | Brooks et al. | |
| 2002/0011320 | A1 | 1/2002 | Ruhland | |
| 2006/0039817 | A1 | 2/2006 | Kelly | |
| 2006/0118211 | A1 | 6/2006 | Elliott | |
| 2008/0213611 | A1 * | 9/2008 | Asgari | A61L 27/04 428/566 |

(Continued)

FOREIGN PATENT DOCUMENTS

JP 2002-370255 12/2002

OTHER PUBLICATIONS

Machine-generated English translation of JP 2002-370255, downloaded from Japan Platform for Patent Information on Aug. 22, 2108.

*Primary Examiner* — Lois L Zheng

(74) *Attorney, Agent, or Firm* — Dascenzo Intellectual Property Law, P.C.

(57) ABSTRACT

A metal injection molding apparatus includes a metal injection mold die having first and second die halves, a first set of features provided in the first die half, a second set of features provided in the second die half and complementary to the first set of features provided in the first are half and an ultrasonic transducer disposed in contact with the metal injection mold die. A binderless metal injection molding method is also disclosed.

20 Claims, 3 Drawing Sheets

(56) References Cited

U.S. PATENT DOCUMENTS

| | | | |
|---|---|---|---|
| 2009/0129961 | A1 | 5/2009 | Lavoie et al. |
| 2012/0058002 | A1 | 3/2012 | Ivasishin et al. |
| 2012/0258008 | A1 | 10/2012 | Hamilton |

* cited by examiner

BINDERLESS METAL INJECTION MOLDING APPARATUS AND METHOD

This application is a continuation of U.S. patent application Ser. No. 13/486,126, filed Jun. 1, 2012, and entitled "Binderless Metal Injection Molding Apparatus and Method," which is a divisional of U.S. patent application Ser. No. 12/034,196, filed Feb. 20, 2008, and entitled "Binderless Metal Injection Molding Apparatus and Method," the disclosures of which are hereby incorporated by reference in their entirety.

TECHNICAL FIELD

The disclosure relates to metal injection molding processes. More particularly, the disclosure relates to binderless metal injection molding apparatus and method which eliminate or minimize shrinkage of green parts.

BACKGROUND

Metal injection molding (MIM) is a manufacturing process in which fine metal powders may be combined with plastic binders that allow the metal be injected into a mold using standard plastic injection molding techniques. After molding and prior to removal of binders from the part, the molded part is known as a "green part". In the traditional MIM process, binders may be used to (1) act as a lubricant so that the metal powder will flow into and fill the complex mold cavities and (2) hold the metal powders together as the green part.

Typically, about 30~40% plastic binders are mixed with the powder before the powder is injected into the mold. After they are stripped from the molds, the green parts may be subjected to a lengthy de-binding process before sintering. The de-binding process may use a chemical solvent to dissolve and carry away most of the binder, after which the remaining binder may be baked out before sintering. Removal of the binders from the green part may result in a 30%~40% reduction in size of the green part. Therefore, design of the parts must be meticulous since the parts may need to be fabricated 30%~40% larger to account for shrinkage.

Therefore, a binderless metal injection molding apparatus and method may be desirable.

SUMMARY

The disclosure is generally directed to a metal injection molding apparatus. An illustrative embodiment of the metal injection molding apparatus includes a metal injection mold die having first and second die halves, a first set of features provided in the first die half, a second set of features provided in the second die half and complementary to the first set of features provided in the first die half and an ultrasonic transducer disposed in contact with the metal injection mold die.

The disclosure is further generally directed to a binderless metal injection molding method. An illustrative embodiment of the method includes providing a metal injection mold die having die features, injecting metal powder into the die features of the metal injection mold die without plastic binder and compacting the metal powder in the die features of the metal injection mold die by inducing ultrasonic vibrations in the metal injection mold die.

BRIEF DESCRIPTION OF THE ILLUSTRATIONS

DETAILED DESCRIPTION

Figure 1:
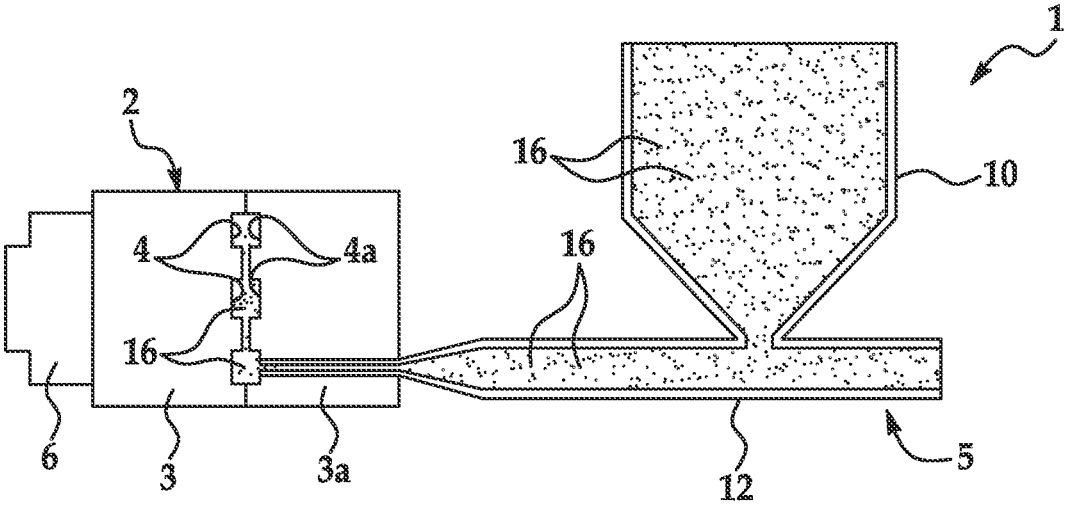
FIG. 1 is a schematic view of an illustrative embodiment of the metal injection molding (MIM) apparatus, illustrating injection of metal powders into die cavities of an MIM mold die.
Figure 2:
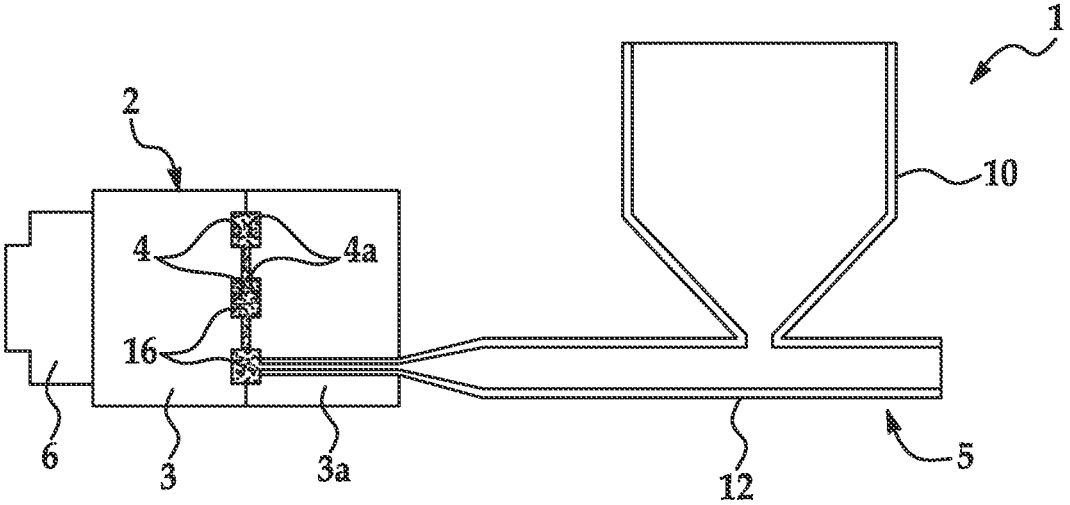
FIG. 2 is a schematic view of an illustrative embodiment of the metal injection molding (MIM) apparatus, illustrating binderless compacting of the metal powders in the die cavities of the MIM mold die by operation of an ultrasonic transducer disposed in contact with the die.
Figure 3:
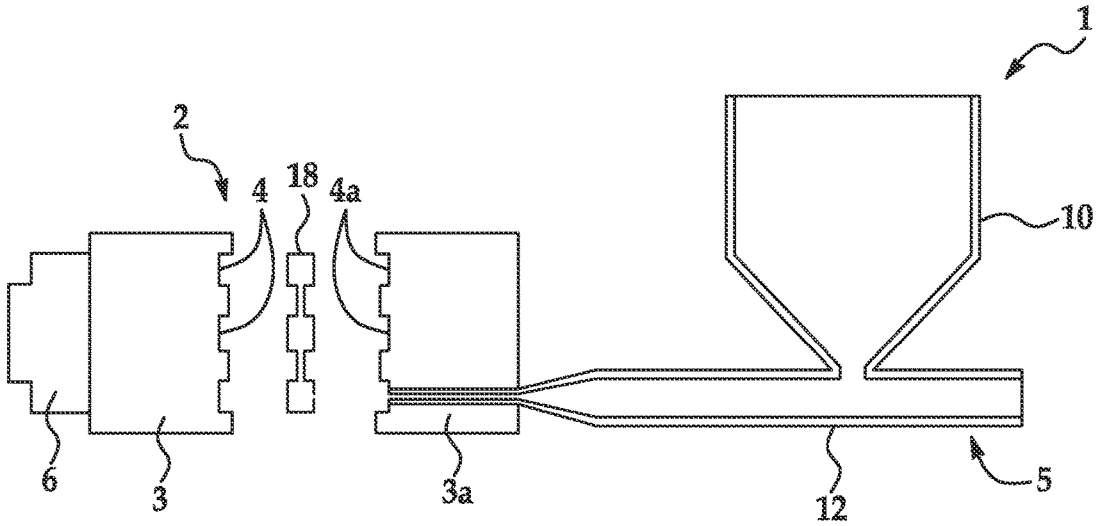
FIG. 3 is a schematic view of an illustrative embodiment of the metal injection molding (MIM) apparatus, illustrating opening of the die halves of the MIM mold die and removal of a molded green part from the die.

Referring initially to FIGS. 1-3 of the drawings, an illustrative embodiment of the metal injection molding (MIM) apparatus is generally indicated by reference numeral 1. The MIM apparatus 1 may include an MIM mold die 2 having a pair of mating die halves 3, 3*a*. In some embodiments, multiple interconnected die cavities 4, 4*a* may be provided in the respective die halves 3, 3*a*. However, it is to be understood that the particular features which are included in each die half 3, 3*a* may vary depending on the part which is to be fabricated using the MIM apparatus 1. The die cavities 4, 4*a* in the respective die halves 3, 3*a* may have any of a variety of sizes and configurations depending on the shape and characteristics of the part which is to be fabricated. The die cavities 4, 4*a* in the respective die halves 3, 3*a* may be complementary and mate with each other when the are halves 3, 3*a* are placed into contact with each other as shown in FIGS. 1 and 2. An ultrasonic transducer 6 may be disposed in physical contact with at least one of the die halves 3, 3*a* to impart ultrasonic vibration to the MIM mold die 2 for purposes which will be hereinafter described.

A metal powder injecting system 5 may be adapted to inject metal powder particles 16 into the die cavities 4, 4*a* in the respective die halves 3, 3*a*. The metal powder injecting system 5 may include a fill hopper 10 which is adapted to contain the metal powder particles 16 without plastic binder. The fill hopper 10 may be disposed in fluid communication with the die cavities 4*a* of one die half 3 such as through an injection conduit 12. The injection conduit 12 may be adapted to distribute the binderless metal powder particles 16 from the fill hopper 10 to the die cavities 4, 4*a* in the respective die halves 3, 3*a*. The metal powder injecting system 5 may have any design which is known to those skilled in the art and suitable for the purpose of distributing the binderless metal powder particles 16 from the fill hopper 10 into the die cavities 4, 4*a* in the respective die halves 3, 3*a*.

In typical application, the MIM apparatus 1 is operated to fabricate a molded metal green part 18 (FIG. 3) using a binderless metal injection molding process. Accordingly, the die halves 3, 3*a* of the MIM mold die 2 may initially be placed together or into contact with each other with the die cavities 4 in the die half 3 completing the complementary die cavities 4*a* in the die half 3*a*. As shown in FIG. 1, the metal powder particles 16 may be placed in the fill hopper 10 without plastic binder. The metal powder injecting system 5 may then be operated to distribute the metal powder particles 16 from the fill hopper 10, through the injection conduit 12 and into the complementary die cavities 4, 4*a* in the respective die halves 3, 3*a* of the MIM mold die 2.

After the desired quantity of the metal powder particles 16 has been distributed into the die cavities 4, 4*a*, the ultrasonic transducer 6 may be operated to impart ultrasonic vibrations to the die halves 3, 3*a* of the MIM mold die 2, as shown in FIG. 2. The ultrasonic vibrations of the MIM die mold 2 compact the binderless metal powder particles 16 in the die cavities 4, 4*a* and form the molded green part 18 from the compacted metal particles 16*a*. As shown in FIG. 3, the die halves 3, 3*a* of the MIM mold die 2 may be separated from each other and the molded green part 18 removed from the die cavities 4, 4*a*. The molded green part 18 may then be sintered and subjected to other post-molding steps which are known to those skilled in the art.

It will be appreciated by those skilled in the art that the ultrasonic vibrations which are imparted to the MIM mold die 2 by the ultrasonic transducer 6 may facilitate fluid flow of the metal powder particles 16 into the die cavities 4, 4*a* and compacting of the powder particles 16 into the compacted metal particles 16*a* to form the molded green part 18. Furthermore, by forming the molded green part 18 without the use of plastic binders, the resulting sintered green part may be of closer tolerances and devoid of residual binders and cheaper and quicker to fabricate. Moreover, the sintered green part may have a higher-quality surface finish as compared to parts which are fabricated using plastic binders.

Figure 4:
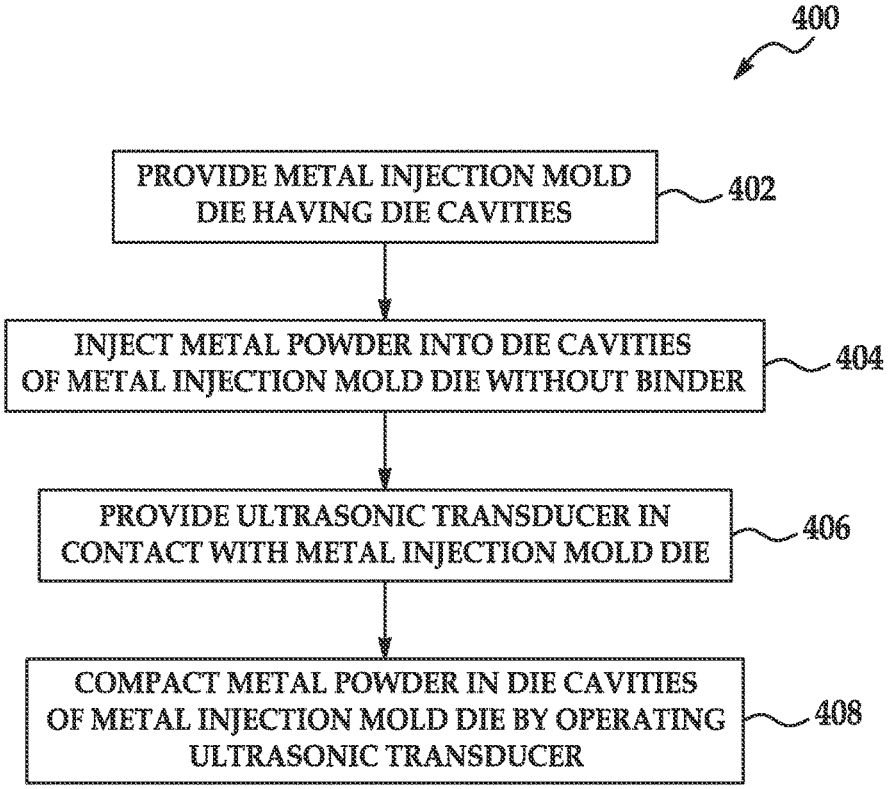
FIG. 4 is a flow diagram which illustrates an illustrative embodiment of a binderless metal injection molding method.

Referring next to FIG. 4, a flow diagram 400 which illustrates an illustrative embodiment of a binderless metal injection molding method is illustrated. In block 402, a metal injection mold die having die cavities or other die features is provided. In block 404, metal powder is injected into the die cavities or other die features of the metal injection mold die without plastic binders. In block 406, an ultrasonic transducer is provided in contact with the metal injection mold die. In block 408, the metal powder in the die cavities or features of the metal injection mold die is compacted by operation of the ultrasonic transducer to form the molded green part.

Figure 5:
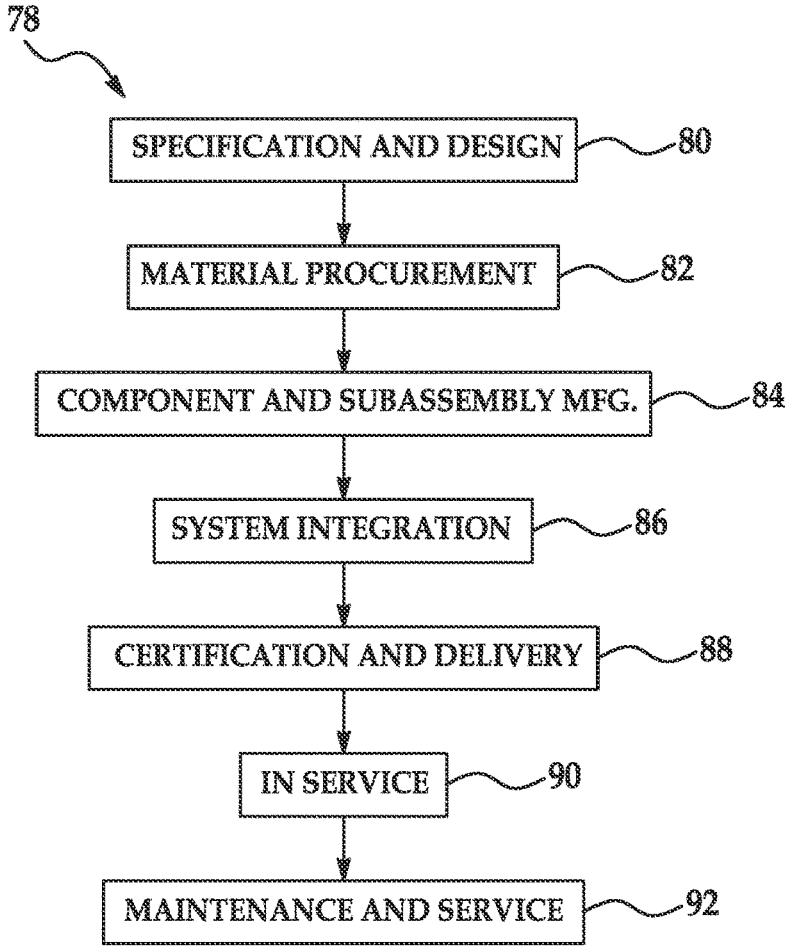
FIG. 5 is a flow diagram of an aircraft production and service methodology.
Figure 6:
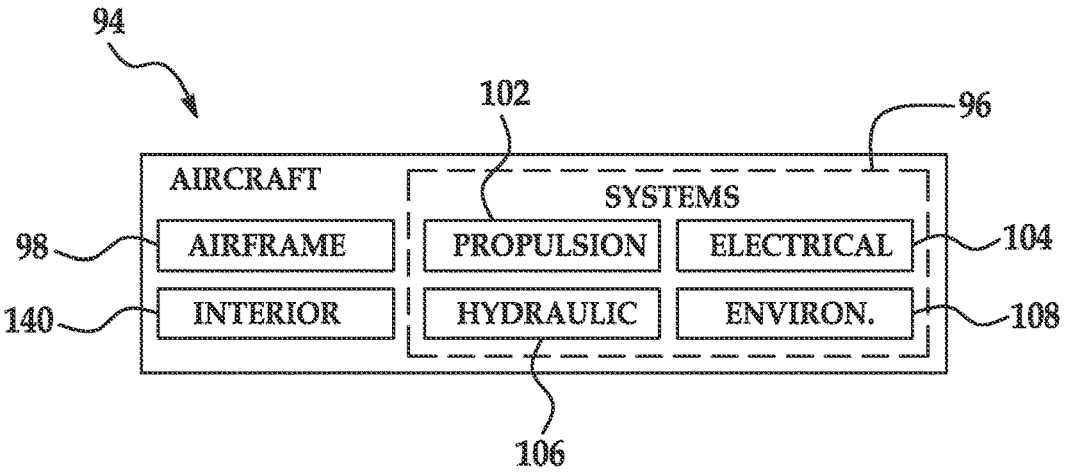
FIG. 6 is a block diagram of an aircraft.

Referring next to FIGS. 5 and 6, embodiments of the disclosure may be used in the context of an aircraft manufacturing and service method 78 as shown in FIG. 5 and an aircraft 94 as shown in FIG. 6. During pre-production, exemplary method 78 may include specification and design 80 of the aircraft 94 and material procurement 82. During production, component and subassembly manufacturing 84 and system integration 86 of the aircraft 94 takes place. Thereafter, the aircraft 94 may go through certification and delivery 88 in order to be placed in service 90. While in service by a customer, the aircraft 94 may be scheduled for routine maintenance and service 92 (which may also include modification, reconfiguration, refurbishment, and so on).

Each of the processes of method 78 may be performed or carried out by a system integrator, a third party, and/or an operator (e.g., customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 6, the aircraft 94 produced by exemplary method 78 may include an airframe 98 with a plurality of systems 96 and an interior 100. Examples of high-level systems 96 include one or more of a propulsion system 102, an electrical system 104, a hydraulic system 106, and an environmental system 108. Any number of other systems may be included. Although an aerospace example is shown, the principles of the invention may be applied to other industries, such as the automotive industry.

The apparatus embodied herein may be employed during any one or more of the stages of the production and service method 78. For example, components or subassemblies corresponding to production process 84 may be fabricated or manufactured in a manner similar to components or subassemblies produced while the aircraft 94 is in service. Also, one or more apparatus embodiments may be utilized during the production stages 84 and 86, for example, by substantially expediting assembly of or reducing the cost of an aircraft 94. Similarly, one or more apparatus embodiments may be utilized while the aircraft 94 is in service, for example and without limitation, to maintenance and service 92.

Although the embodiments of this disclosure have been described with respect to certain exemplary embodiments, it is to be understood that the specific embodiments are for purposes of illustration and not limitation, as other variations will occur to those of skill in the art.

What is claimed is:

1. A binderless metal injection molding method, comprising:

distributing only binderless metal powder into a cavity, wherein the binderless metal powder consists of metal particles;

compacting the binderless metal powder by inducing ultrasonic vibrations to form a green part within the cavity;

removing the green part from the cavity; and sintering, after the removing, the green part to form a sintered part.

2. The method of claim 1, wherein the distributing includes distributing the binderless metal powder into the cavity without using plastic binder.

3. The method of claim 1, wherein the distributing includes imparting ultrasonic vibrations to flow the binderless metal powder into the cavity.

4. The method of claim 1, wherein the distributing includes injecting the binderless metal powder into the cavity.

5. The method of claim 1, wherein the distributing includes distributing the binderless metal powder into the cavity through an injection conduit in a mold die that defines the cavity.

6. The method of claim 1, wherein the compacting includes forming the green part without using plastic binder.

7. The method of claim 1, wherein the cavity defines at least a portion of an enclosed space.

8. The method of claim 1, wherein the cavity is in a first die half of a mold die, and wherein the method further comprises placing the first die half into contact with a second die half of the mold die to form an enclosed space defined in part by the cavity.

9. The method of claim 1, wherein cavity is a first cavity, wherein a mold die includes a first die half that defines the first cavity, and a second die half that defines a second cavity, and wherein the method further comprises placing the first die half and the second die half together to form an enclosed space between the first cavity and the second cavity.

10. The method of claim 1, wherein the compacting includes compacting the binderless powder in an enclosed space.

11. The method of claim 1, wherein the compacting includes compacting by solely inducing ultrasonic vibrations to form the green part.

12. The method of claim 1, wherein the removing includes separating the cavity from the green part.

13. The method of claim 1, wherein the sintering results in the sintered part being devoid of residual binders.

14. A binderless metal injection molding method, comprising:

assembling a first die member and a second die member together to form a mold die with an enclosed space, wherein the first die member defines a first cavity, the second die member defines a second cavity, and the enclosed space is formed of at least the first cavity and the second cavity;

distributing only binderless metal powder into the enclosed space, wherein the binderless metal powder consists of metal particles;

compacting the binderless metal powder by inducing ultrasonic vibrations in the mold die to form a green part within the enclosed space;

separating the green part from the mold die; and sintering, after the separating, the green part to form a sintered part.

15. The method of claim 14, wherein the distributing includes distributing the binderless metal powder into the cavity without using plastic binder.

16. The method of claim 14, wherein the distributing includes imparting ultrasonic vibrations to flow the binderless metal powder into the enclosed space.

17. The method of claim 14, wherein the distributing includes distributing the binderless metal powder into the enclosed space through an injection conduit in the mold die.

18. The method of claim 14, wherein the compacting includes compacting by solely inducing ultrasonic vibrations to form the green part.

19. The method of claim 14, wherein the sintering results in the sintered part being devoid of residual binders.

20. A binderless metal injection molding method, consisting essentially of:

distributing only binderless metal powder into a cavity, wherein the binderless metal powder consists of metal particles;

compacting the binderless metal powder by inducing ultrasonic vibrations to form a green part within the cavity;

removing the green part from the cavity; and sintering, after the removing, the green part to form a sintered part.

* * * * *